US006227871B1

(12) United States Patent
Bender

(10) Patent No.: US 6,227,871 B1
(45) Date of Patent: May 8, 2001

(54) DEVICE FOR CONTACT-CONNECTING A CIRCUIT BOARD

(75) Inventor: Günther Bender, Rodheim (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/405,277

(22) Filed: Sep. 23, 1999

(30) Foreign Application Priority Data

Sep. 24, 1998 (DE) ..... 198 43 770

(51) Int. Cl.[7] ..... H01R 12/00

(52) U.S. Cl. ..... 439/67; 439/65; 439/76.1; 439/493

(58) Field of Search ..... 439/67, 65, 66, 439/76.1, 515, 591, 493, 329

(56) References Cited

U.S. PATENT DOCUMENTS

| | | | |
|---|---|---|---|
| 4,161,346 | | 7/1979 | Cherian et al. . |
| 4,812,803 | | 3/1989 | Hochholzer . |
| 5,271,269 | | 12/1993 | Rilling et al. . |
| 5,395,253 | * | 3/1995 | Crumly ..... 439/67 |
| 5,505,626 | * | 4/1996 | Grabbe et al. ..... 439/67 |
| 5,865,650 | * | 2/1999 | Marian, Jr. et al. ..... 439/76.1 |

FOREIGN PATENT DOCUMENTS

| | | |
|---|---|---|
| 259707 | 8/1988 | (DE) . |
| 3818553 | 12/1988 | (DE) . |
| 4108735 | 9/1992 | (DE) . |
| 4241020 | 6/1994 | (DE) . |
| 19713838 | 10/1998 | (DE) . |
| 19719942 | 12/1998 | (DE) . |
| 0573690 | 12/1993 | (EP) . |
| 2315925 | 2/1998 | (GB) . |

* cited by examiner

*Primary Examiner*—Paula Bradley
*Assistant Examiner*—Tho D. Ta
(74) *Attorney, Agent, or Firm*—Martin A. Farber

(57) ABSTRACT

In a device (23) for contact-connecting two circuit boards (17, 18) for a control device of a throttle valve of an internal combustion engine of a motor vehicle, contacts (24, 25) of one of the circuit boards (17) are arranged on a holding part (20). The holding part (20) is prestressed toward contacts (25) of the other circuit board (18). The holding part (20) is connected to said one circuit board (17) via elastic connecting lines (22). Tolerance compensation is provided as a result of this. Furthermore the circuit boards (17, 18) are reliably contact-connected to one another.

9 Claims, 2 Drawing Sheets

DEVICE FOR CONTACT-CONNECTING A CIRCUIT BOARD

BACKGROUND OF THE INVENTION

The invention relates to a device for contact-connecting a circuit board of an electronic control device of an actuator, in particular of a throttle valve of an internal combustion engine of a motor vehicle, the control device and the actuator forming a structural unit with contacts arranged on a first structural part and with contacts which are connected to a second structural part and are conductively connected to the contacts of the first structural part.

In the case of throttle valves used to regulate the power of the internal combustion engine of motor vehicles, usually one or a plurality of circuit boards of the electronic control device are arranged in a pot-shaped housing. The housing is produced in one piece with a throttle valve connector bearing the throttle valve and is closed off by a cover. The throttle valve connector has a flange for direct screwing to the internal combustion engine. Terminal contacts for the on-board electrical system and for signal lines are arranged in the cover. This results in a very compact construction for the throttle valve connector with all the structural parts required for regulating the power, such as the circuit boards and the cover with the terminal contacts.

At their contacts, the circuit boards and the terminal contacts of the cover are electrically contact-connected to one another and to a servomotor for the throttle valve. Since the contact connection has to withstand high temperatures and vibrations, particularly in the case of the circuit boards which are fixed in the throttle valve connector, the contacts are usually connected to one another by laser welding. However, laser welding is very costly and leads to very cost-intensive assembly of the throttle valve connector.

SUMMARY OF THE INVENTION

The invention is based on the problem of configuring a device of the type mentioned in the introduction in such a way that the electrical connection of the contacts becomes as cost-effective as possible and that the connection subsequently withstands high temperatures and vibrations in a particularly reliable manner.

This problem is solved according to the invention by virtue of the fact that the contacts of the second structural part are arranged on a holding part, that the holding part is prestressed toward the first structural part, and that the second structural part is connected to the holding part via elastic connecting lines.

By virtue of this configuration, the circuit board is contact-connected in a region in which no mechanical loads act on the connection point. Therefore, vibrations do not lead to friction between the contacts and thus do not lead to the destruction of said contacts. Tolerances between the structural parts and movements of the structural parts relative to one another are compensated for by the connecting lines. As a result, the contact-making device according to the invention has particularly high reliability. Since no soldering points are necessary for the contact-making device according to the invention, said device is particularly suitable for use in internal combustion engines of motor vehicles.

The prestressing of the holding part could be effected for example by a clamp arranged on the first structural part. However, fastening the clamp on the holding part necessitates an additional work operation when the structural parts are joined together. In accordance with an advantageous development of the invention, the prestressing of the holding part is effected without any additional outlay on assembly when the structural parts are joined together, if a spring element for prestressing the holding part toward the first structural part is arranged between the second structural part and the holding part.

The device according to the invention becomes particularly cost-effective if the elastic connecting lines are formed by conductor tracks printed onto a sheet.

The production of the holding part as a separate structural part leads only to an insignificant increase in the production costs of the device according to the invention if the holding part and the second structural part are produced from the same plastic and are connected to one another via a web which is thin in relation to their material thicknesses. In this case, the web may optionally serve as a desired breaking point between the second structural part and the holding part or be configured in an elastic fashion enabling the structural parts to move relative to one another.

In accordance with another advantageous development of the invention, a movement of the holding part relative to the first structural part can be avoided in a simple manner if the holding part has guide pins and the first structural part has holes corresponding to the guide pins.

In accordance with another advantageous development of the invention, the holding part is reliably prestressed toward the first structural part if the second structural part has a guide element for the spring element.

The device according to the invention becomes particularly simple in structural terms if the spring element is a helical spring and the guide element is a sleeve.

By way of example, the contacts could be configured as contact laminae in each case. For the purpose of contact connection, mutually opposite contact laminae could be perpendicularly prestressed toward one another. However, in order to avoid friction between the contacts, this configuration requires very high prestressing forces and particularly accurate guidance of the holding part relative to the first structural part. Friction between the contacts would lead to the electrically conductive connection being destroyed. However, in accordance with another advantageous development of the invention, friction between the contacts can be avoided in a simple manner if the contacts of the second structural part are in pin form and the contacts of the first structural part are prestressed laterally toward the contacts of the second structural part. The lateral prestressing can be effected in a very simple manner by virtue of appropriate shaping of the contacts of the first structural part.

BRIEF DESCRIPTION OF THE DRAWINGS

The invention permits numerous embodiments. In order to further elucidate its basic principle, one of these embodiments is illustrated in the drawings and is described below.

In the figures.

DETAILED DESCRIPTION OF THE PREFERRED EMBODIMENT

Figure 1:
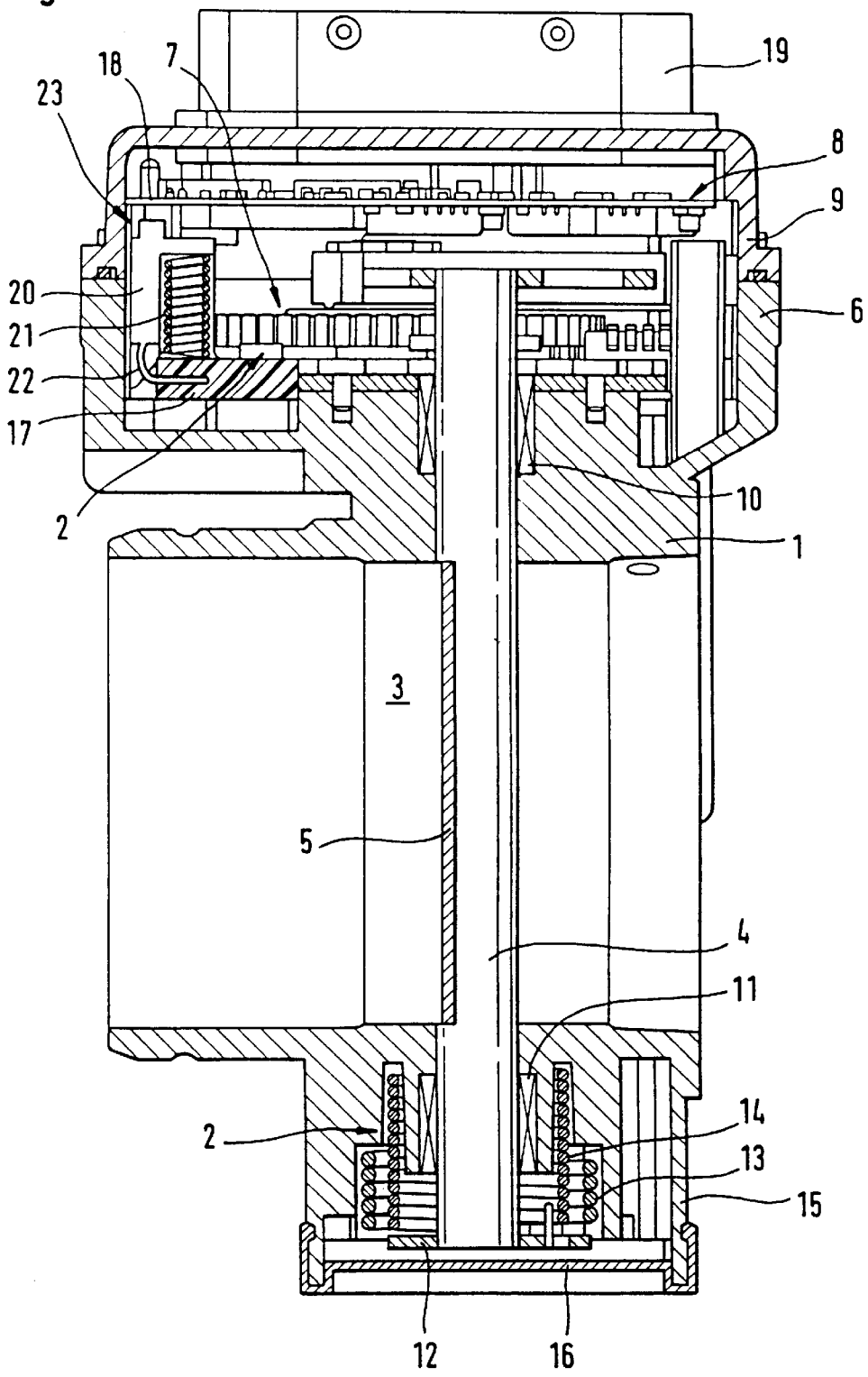
FIG. 1: shows a throttle valve connector with a control device in a longitudinal section.

FIG. 1 shows a throttle valve connector 1 with a load adjusting apparatus 2. The load adjusting apparatus 2 has an actuating shaft 4 penetrating through a duct 3. A throttle valve 5 serving to regulate a free cross-sectional area of the duct 3 is fastened on the actuating shaft 4. The actuating shaft 4 is swiveled by an actuating gear mechanism 7 arranged in a pot-shaped housing 6 of the throttle valve connector 1. Furthermore, a control device 8 for driving an electric motor (not illustrated) is arranged in the housing 6. The electric motor enables the actuating gear mechanism 7 to be driven and thus the actuating shaft 4 to be swiveled. The pot-shaped housing 6 of the throttle valve connector 1 is closed off by a cover 9.

The throttle valve connector 1 has two bearings 10, 11 for the actuating shaft 4. An actuating lever 12 is fastened to that end of the actuating shaft 4 which is opposite to the actuating gear mechanism 7. An emergency running spring 13 and a restoring spring 14 are arranged concentrically around the bearing 11 of this end of the actuating shaft 4. The restoring spring 14 and the emergency running spring 13 are each configured as leg springs and arranged in a well-like housing 15. The housing 15 is closed off by a cover 16.

The control device has two circuit boards 17, 18 arranged one above the other. Arranged in the cover 9 is a socket 19 by means of which the control device 8 is connected to an on-board electrical system (not illustrated) of the motor vehicle for power supply and/or for data exchange purposes (for example via a CAN bus). The two circuit boards 17, 18 are electrically connected to one another by means of a device 23 according to the invention. A holding part 20 is arranged between the two circuit boards 17, 18. The holding part 20 is prestressed by a spring element 21—designed as a helical spring—toward the upper circuit board 18 and is connected to the lower circuit board 17 by means of elastic connecting lines 22.

Figure 2:
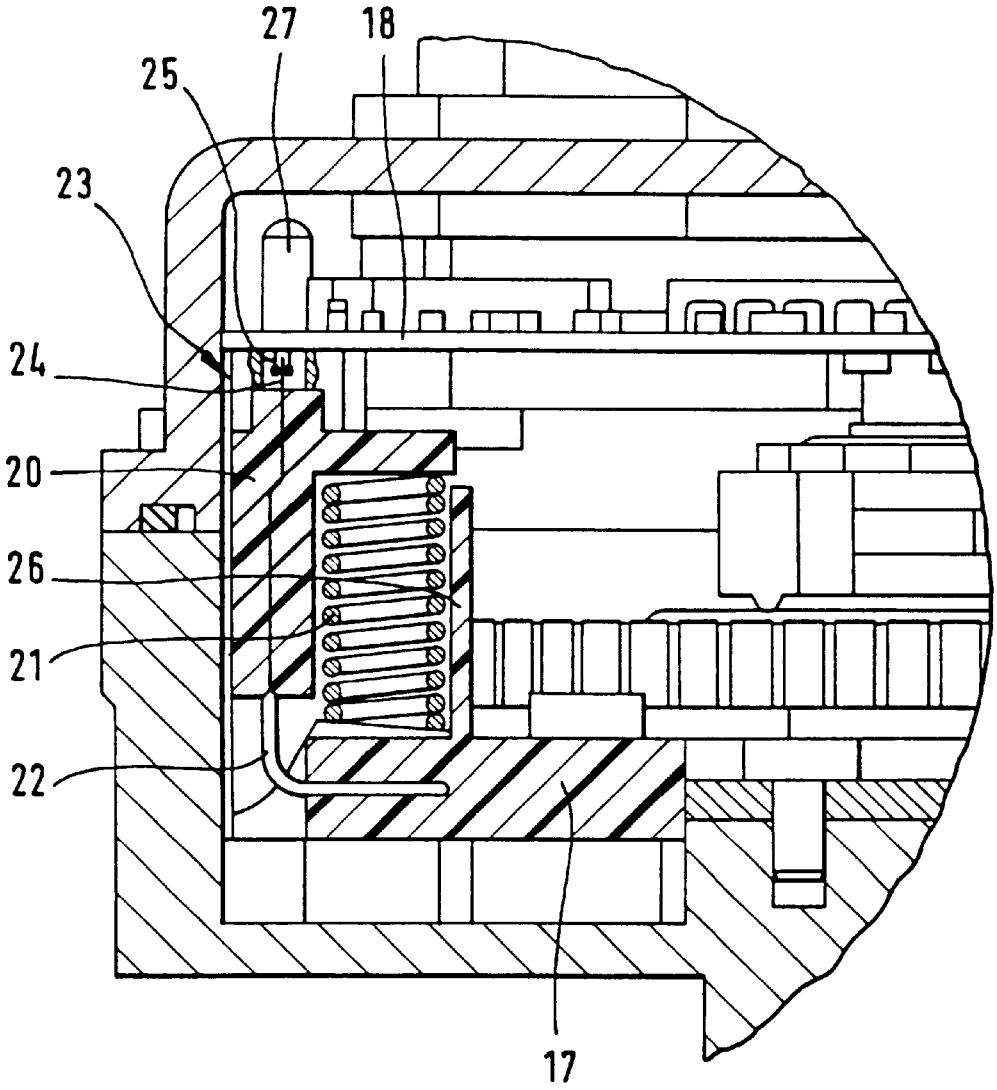
FIG. 2: shows an enlarged illustration of a device according to the invention from FIG. 1.

FIG. 2 illustrates the device 23 according to the invention in a greatly enlarged manner in a partial section through the holding part 20 and a partial region of the upper circuit board 18. The electrical connecting lines 22 are routed as far as contacts 24 arranged on the holding part 20. The contacts 24 of the holding part 20 are connected to contacts 25 of the upper circuit board 18. In this case, the contacts 25 of the upper circuit board 18 are prestressed laterally toward the contacts 24 of the holding part 20. Furthermore, FIG. 2 shows that the spring element 21 is guided vertically by a guide element 26 designed as a sleeve. The holding part 20 has guide pins 27 and the first structural part or circuit board 18 has holes corresponding to the guide pins 27.

It goes without saying that the device according to the invention can also be used to contact-connect the socket 19 illustrated in FIG. 1 to the electronic control unit 8.

LIST OF REFERENCE SYMBOLS

1. Throttle valve connector
2. Load adjusting apparatus
3. Duct
4. Actuating shaft
5. Throttle valve
6. Housing
7. Actuating gear mechanism
8. Electronic control unit
9. Cover
10. Bearing
11. Bearing
12. Actuating lever
13. Emergency running spring
14. Restoring spring
15. Housing
16. Cover
17. Circuit board
18. Circuit board
19. Socket
20. Holding part
21. Spring element
22. Connecting line
23. Device
24. Contact
25. Contact
26. Guide element
27. Guide pin

What is claimed is:

1. A device contact-connecting a first structural part (or first circuit board 18) to a second structural part (or second circuit board 17) of an electronic control device of an actuator, comprising the control device and the actuator forming a structural unit, the control device comprising said first and second structural parts, first contacts (25) arranged on the first structural parts and second contacts (24) which are connected to the second structural parts and wherein said first contacts are conductively connected to the second contacts, a holding part (20), and elastic connecting lines (22), wherein the second contacts (24) are arranged on said holding part (20), wherein the holding part (20) is prestressed toward the first structural part (or first circuit board 18) for connecting the second contacts (24) of the holding part with the first contacts (25) of the first structural part, and wherein the second structural part (or second circuit board 17) is connected to the second contacts (24) which are arranged on said holding part (20) by said elastic connecting lines (22).

2. The device as claimed in claim 1, wherein the elastic connecting lines (2) are formed by conductor tracks printed onto a sheet.

3. The device as claimed in claim 1, wherein the holding part (20) and the second structural part (circuit board 17) are produced from the same plastic and are connected to one another via a web which is thin in relation to their material thicknesses.

4. The device as claimed in claim 1, wherein the holding part (20) has guide pins (27) and the first structural part (circuit board 18) has holes corresponding to the guide pins (27).

5. The device as claimed in claim 1, wherein the contacts (24) of the second structural part (circuit board 17) are in pin form and the first contacts (25) of the first structural part (circuit board 18) are prestressed laterally toward the second contacts (24) of the second structural part (circuit board 17).

6. The device as claimed in claim 1, wherein the actuator is a throttle valve of an internal combustion engine of a motor vehicle.

7. The device as claimed in claim 1, wherein a spring element (21) for prestressing the holding part (20) toward the first structural part (circuit board 18) is arranged between the second structural part (circuit board 17) and the holding part (20).

8. The device as claimed in claim 7, wherein the second structural part (circuit board 17) has a guide element (26) for the spring element (21).

9. The device as claimed in claim 8, wherein the spring element (21) is a helical spring and the guide element (26) is a sleeve.

* * * * *